US005846101A

United States Patent [19]

Duchemin et al.

[11] Patent Number: 5,846,101

[45] Date of Patent: Dec. 8, 1998

[54] CONNECTION BLOCK FOR CONNECTING ELECTRICAL CONDUCTORS TO ELECTRICAL EQUIPMENT

[75] Inventors: Jean-Pierre Duchemin, Jouy-le-Moutier; Bruno Jacquet, Mantes la Jolie; Régis Perrocheau, Jouy-le-Moutier, all of France

[73] Assignee: Schneider Electric SA, Boulogne Billancourt, France

[21] Appl. No.: 734,455

[22] Filed: Oct. 17, 1996

[30] Foreign Application Priority Data

Oct. 18, 1995 [FR] France ..... 95 12327

[51] Int. Cl.[6] ..... H01R 4/38

[52] U.S. Cl. ..... 439/812; 439/794

[58] Field of Search ..... 439/791, 794, 439/811, 812, 136, 793

[56] References Cited

U.S. PATENT DOCUMENTS

| | | | |
|---|---|---|---|
| 2,456,808 | 12/1948 | Becker | 439/794 |
| 4,790,778 | 12/1988 | Seidenbusch | 439/811 |

FOREIGN PATENT DOCUMENTS

| | | | |
|---|---|---|---|
| 1124232 | 6/1956 | France | 439/791 |
| 2 052 800 | 4/1971 | France . | |
| 2 601 513 | 1/1988 | France . | |
| 2 612 340 | 9/1988 | France . | |
| WO 95/03641 | 2/1995 | WIPO . | |

*Primary Examiner*—Gary F. Paumen
*Assistant Examiner*—Tho D. Ta
*Attorney, Agent, or Firm*—Oblon, Spivak, McClelland, Maier & Neustadt, P.C.

[57] ABSTRACT

Connection block for connecting cables (5, 6) to electrical equipment (2) comprising at least one connector (4) consisting of a cage (42) and a wire clamp slide (43) moved by a clamping screw (44) under a compartment (37, 38) in a box (31) in which said connector is placed, characterized in that the slide (43) is U-shaped with one flange at the same level as the screw head (44), and that this flange has a mobile insulating protective cover (35) on its front which follows slide movements and provides access to the screw head.

8 Claims, 3 Drawing Sheets

CONNECTION BLOCK FOR CONNECTING ELECTRICAL CONDUCTORS TO ELECTRICAL EQUIPMENT

This invention relates to a connection block for connecting cables to an electrical equipment, comprising at least one connector composed of a cage and a mobile wire clamp slide under the action of a clamping screw, inside a compartment in a box housing said connector.

There is a type of connector used to connect cables to electrical equipment consisting of a cage and a wire clamp slide moved by a clamping screw, in the electrical appliance box. The disadvantage of these connectors is that access to the clamping screw is difficult.

The purpose of this invention is to supply a connection block in which a tool can more easily access clamping screws, while improving the protection. The solution adopted is to prevent wiring errors and to protect persons from touching parts conducting electricity, regardless of the diameter of the cables to be connected and to protect connection parts against dust and impurities.

The connection block according to the invention is characterized in that the slide is U-shaped, with one flange of the U at the same level as the screw head and this flange supports a mobile protective insulating cover on the front, which protects the front of the slide, follows the movements and allows access to the screw head.

According to one feature, the front cover covers the top of a wire clamp slide to partially or completely open or close a box compartment used for passing cables.

According to one feature, there is an insulating cover at the back of the block which covers the back of the cage and follows its movements so as to open or close a compartment in the box used for passing cables.

According to one feature, each of the connectors comprises a fixed electrical conductor connected to the apparatus and fitting between the bottom of the cage and the slide, and used for clamping two separate cables.

The invention will now be described in more detail, with reference to an embodiment given as an example shown on the drawings in the appendix in which.

Figure 1:
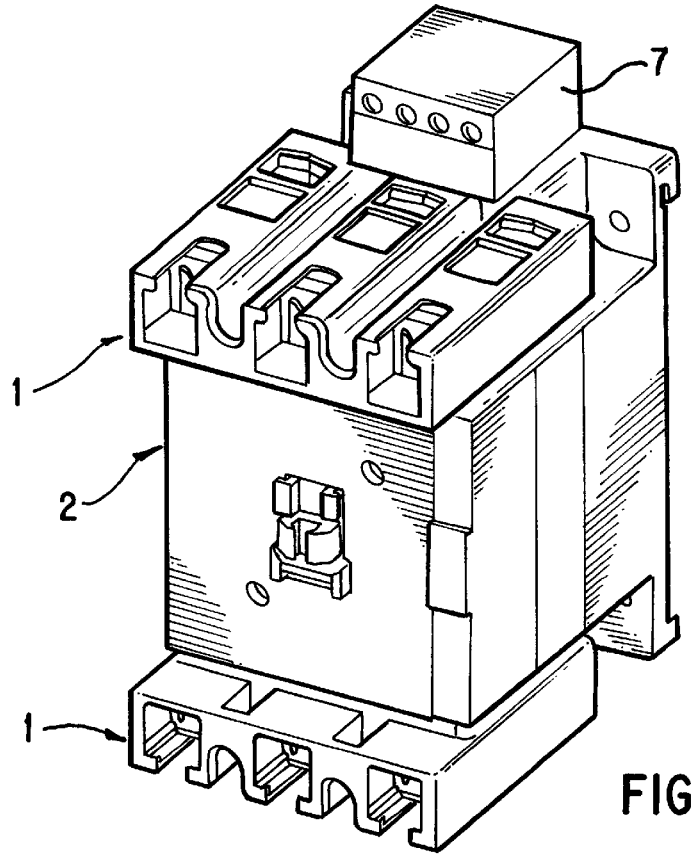
FIG. 1 is a perspective view of equipment (contactor type) fitted with two connection blocks according to the invention.
Figure 2:
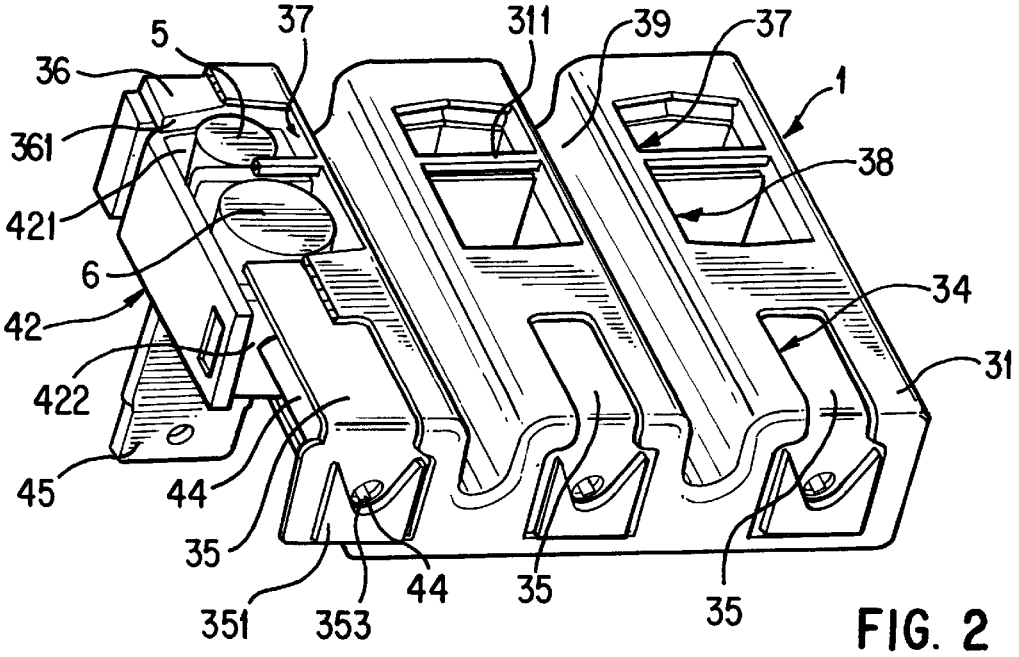
FIGS. 2, 3 and 4 are perspective views of a block shown with two cables, one cable and no cables respectively.

Reference 2 shows an electrical equipment 2 (contactor type) on which two connection blocks 1 are mounted used to connect electrical cables mark 5 and 6. These blocks 1 are assembled to equipment 2 by assembly means known in existing technology.

Each block 1 comprises a box 31 in which chambers 32 are formed (one for each pole on the equipment) which open up towards the front through openings 33 and each contains a connector 4 that can be used to connect electrical cables 5 and 6 to the equipment.

The outside of box 31 is cut out above each connector 4 by two compartments 37 and 38, which can be used to insert the ends of two cables 5 and 6 into said connector.

Each connector consists of a cage 42 and a mobile wire clamp slide 43, each under compartments 37, 38 into which the ends of cables 5, 6 to be connected are inserted. The general shape of cage 42 is prismatic, and it is composed of a stirrup 421 assembled to a nut crossing 422 through which a thread is drilled for a recessed head clamping screw 44.

The cage can move freely inside the chamber in which it is located, as a function of the diameters of cables 5 and 6 to be connected. In the embodiment shown, screw 44 shows a hexagonal setscrew.

Each connector 4 also includes a fixed electrical conductor 45 that passes through a slot in the box, the extended end of which is fitted with a fixed contact of the contactor. This conductor 45 separates the two compartments 37 and 38 which open up on each side of this conductor 45. The cage 42 is mounted in the associated chamber 32 such that the conductor 45 is located between the bottom of stirrup 421 and the nut crossing 422.

The wire clamp slide 43 is moved in translation by screw 44 which screws into cage 42. This slide is in a U-shape. Flange 431 of slide 43 clamps cable 6 and fits into cage 42, whereas flange 432 of the same slide fits outside the cage at the same height as the screw head. A hole is formed in this flange 432 to contain the screw head and through which a screwdriver can be inserted to turn the screw in or out. Screw 44 and slide 43 are kept together in translation in one direction by thrust from the end of the screw, and in the other direction by a collar on the screw head.

By rotation of screw 44, the screw-nut system 42–44 can clamp firstly a cable 5 between the bottom of stirrup 421 and conductor 45, and secondly a cable 6 between conductor 45 and the wire clamp slide 43.

Figure 5:
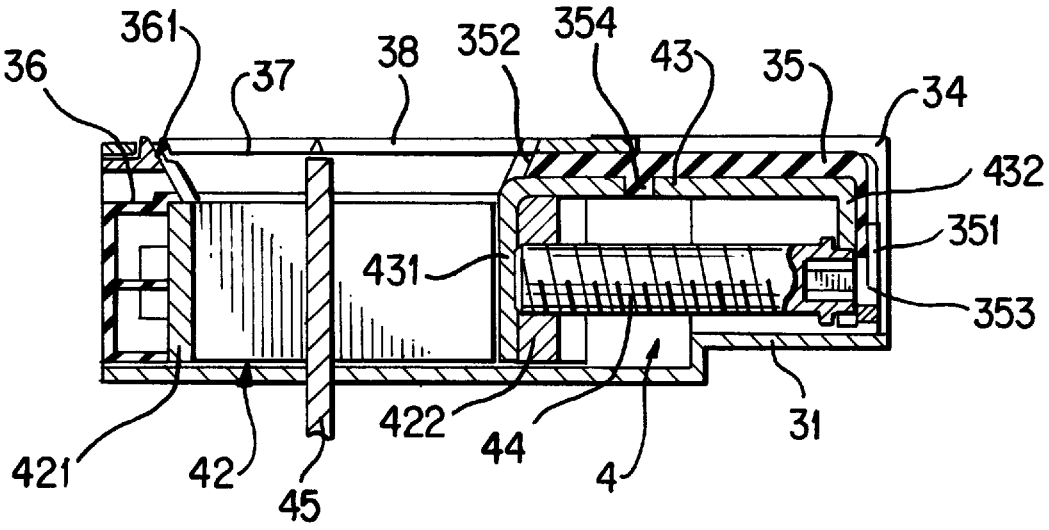
FIG. 5 is a section through a connector along the center line of its clamping screw.

At the front, the block comprises a mobile insulating cover 35 (plastic) that covers the front (on the screw head side) and the top of the wire clamp slide 43, and follows its movements so as to partially or fully open or close compartment 38. This insulating cover 35 is fixed in translation to the associated wire clamp slide 43 through a mechanical link using known technology. In the embodiment shown in FIG. 5, this link is made by a pin 354 on the cover which is housed in a hole in the slide 43.

The front of the cover 35 contains a hole 353 that can be used to turn screw 44 in and out, and a part in relief 351 (V-shape) used as a screwdriver guide. Since the screwdriver guide 351 follows the screw translation movements, it facilitates access to the screw without forcing the wiring fitter to be in a specific position with respect to the block.

At the back, the block contains an insulating cover 36 (plastic) supported by the back of cage 42, and which follows its movements so as to partially or fully open or close compartment 37. This mobile insulating cover 36 covers the back of the coupling over stirrup 421. The mechanical link between this rear cover 36 and the cage 42 is provided by appropriate means using known technology (for example clipping cover 36 on the cage).

Clearances 34 are provided on the top of box 31 to facilitate access to the clamping screw heads 44. Note that a bridge 311 on the box separates compartments 37 and 38. It is positioned above conductor 45 and thus protects users from contact with this conductor.

The back edge 352 of the front insulating cover 35 acts as a wire guide for a cable such as 6. Similarly, the front edge 361 of the rear insulating cover 36 acts as a wire guide for a cable such as 5.

Between connectors 4, box 31 includes grooves 39 to facilitate access to terminals, for example such as coil terminals, without increasing the size. They can be used to contain add-on parts 7.

We will now explain operation of the device.

The front insulating cover 35 follows the movement of the clamping screw 44 and the wire clamp slide 43 and releases a wiring space corresponding to the diameter of cable 6. The rear insulating cover 36 also follows the movements of cage 42 and releases a wiring space corresponding to the diameter of cable 5.

Figure 3:
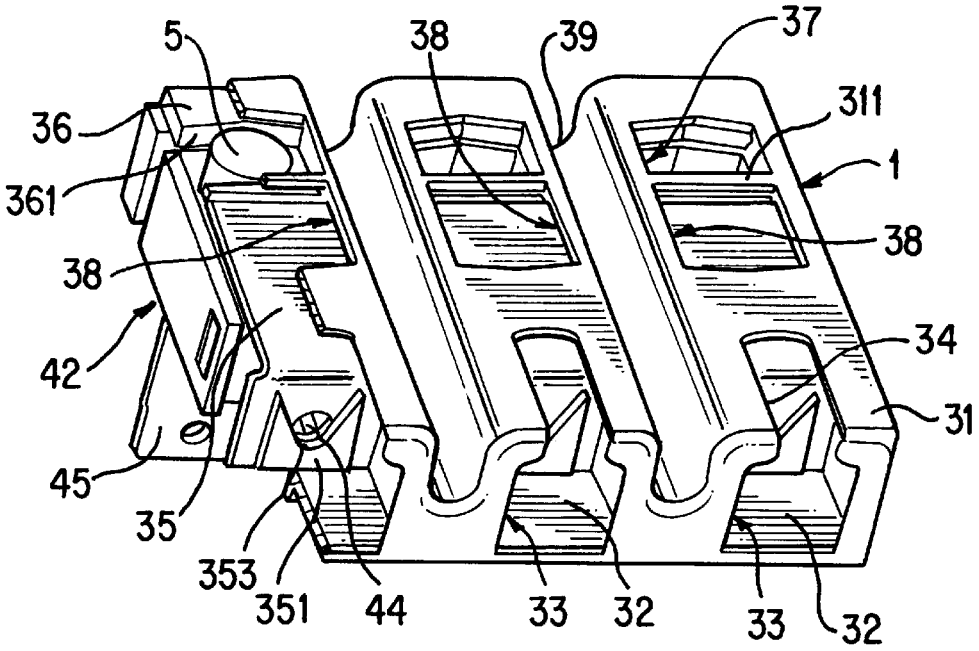

If the rear of the connector only contains one cable 5, the front compartment 38 is then completely closed by cover 35 (FIG. 3) which protects it from being touched, prevents impurities from entering and prevents a cable from being inserted outside the required area. The front of the front cover 351 follows the screw head which gives maximum screw visibility and accessibility.

If the connector only contains one cable 6 in its front part, the rear compartment 37 is then completely closed by cover 36, which also protects it from being touched, prevents impurities from entering and prevents a cable from being inserted outside the required area.

Figure 4:
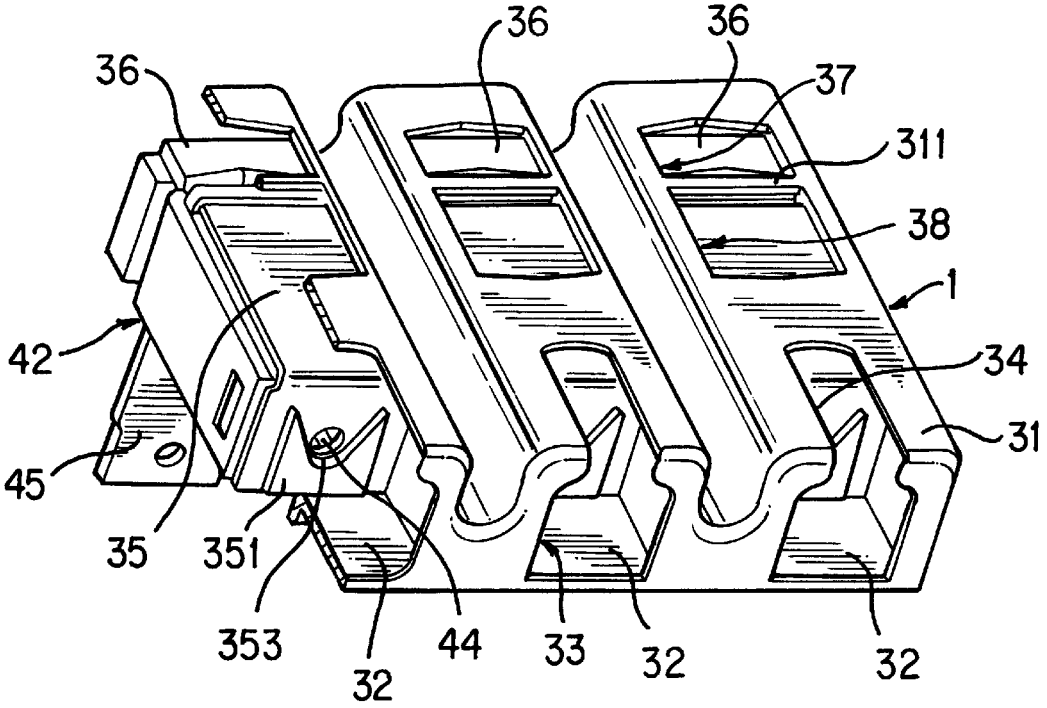

If there are no cables in the connector (FIG. 4) then covers 35 and 36 completely close compartments 37 and 38.

Obviously, many alternatives and detailed improvements could be imagined within the framework of the invention, and equivalent means could also be used. The block can hold as many connectors as necessary.

Connectors operate with the cage fixed in position (simple wiring) or free (double wiring).

We claim:

1. A connection block for connecting cables to an electrical equipment comprising:

at least one connector;

box in which said connector is placed;

said box having two openings through which said cables may be inserted;

said connector including two compartments arranged under said openings for receiving said cables;

said connector including a cage for connecting one of said cables, said connector also including a wire clamp slide for connecting another of said cables, said cage and said slide both being moved by a clamping screw;

said slide being U-shaped and providing access to said clamping screw;

said slide having mounted thereon an insulating front cover with a front portion and a top portion, said front portion protecting and insulating the front of the slide, said top portion covering the top of the slide and wherein by rotation of said clamping screw, said top portion forms a cover for one of said compartments when said another of said cables is not present therein, said cage has mounted thereon an insulating back cover that protects and insulates a back of said cage and wherein by said rotation of said clamping screw, the back cover forms a cover for another of said compartments when said one of said cables is not present therein.

2. Block according to claim 1, characterized in that the cable clamp slide includes one flange that is mobile in the cage and is used to clamp the cable, and one flange outside the cage.

3. Block according to claims 1, characterized in that there are openings on the top of the box to facilitate access to the heads of clamping screws.

4. Block according to claim 1, characterized in that edges of the front cover and the rear cover act as wire guides.

5. Block according to claim 4, characterized in that front of the front cover contains a hole through which a screw can be turned in or out, and a screwdriver guide.

6. Block according to claim 1, characterized in that between its connectors, the box includes grooves providing access to its terminals, for fitting add-on parts.

7. Block according to claim 1, characterized in that each of the connectors includes a fixed electrical conductor connected to the equipment and fitting between the bottom of the cage and the wire clamp side, and used for clamping two separate cables.

8. Block according to claim 7, characterized in that the conductor separates two compartments and that the box contains a bridge above this conductor.

* * * * *